US005852877A

United States Patent [19]

Lotarski et al.

[11] Patent Number: 5,852,877

[45] Date of Patent: Dec. 29, 1998

[54] METHOD AND APPARATUS FOR SKIVING BELT ENDS

[75] Inventors: David A. Lotarski, Bolingbrook; Joseph C. Vogrig, Naperville, both of Ill.

[73] Assignee: Flexible Steel Lacing Company, Downers Grove, Ill.

[21] Appl. No.: 685,275

[22] Filed: Jul. 23, 1996

Related U.S. Application Data

[63] Continuation of Ser. No. 301,696, Sep. 7, 1994, abandoned.

[51] Int. Cl.[6] ..... B26D 3/06; B26D 3/28

[52] U.S. Cl. ..... 30/290; 83/870; 83/874; 69/9

[58] Field of Search ..... 83/352, 353, 382, 83/423, 425, 426, 428, 435, 436, 488, 614, 633, 640, 734, 745, 856, 857, 858, 870, 874, 875, 743; 30/476, 170, 290; 69/9, 11, 13

[56] References Cited

U.S. PATENT DOCUMENTS

| | | | |
|---|---|---|---|
| 158,946 | 1/1875 | King | 83/382 |
| 493,351 | 3/1893 | Burbank | 83/488 |
| 887,625 | 5/1908 | Grant | 69/13 |
| 3,137,192 | 6/1964 | McNeil | 83/614 |
| 3,515,019 | 6/1970 | Tyler, Jr. | 83/5 |
| 3,534,646 | 10/1970 | Tyler, Jr. | 83/5 |
| 3,695,713 | 10/1972 | Rothi et al. | 30/170 |
| 4,315,450 | 2/1982 | Pray | 83/862 |
| 4,549,350 | 10/1985 | Patillo | 30/170 |
| 4,754,678 | 7/1988 | Nichols et al. | 83/875 |
| 5,036,740 | 8/1991 | Tsai | 83/614 |
| 5,193,276 | 3/1993 | Konig et al. | 30/90.1 |

FOREIGN PATENT DOCUMENTS

| | | |
|---|---|---|
| 240972A1 | 10/1987 | European Pat. Off. . |
| 366313 | 2/1932 | United Kingdom . |
| 2009016 | 6/1979 | United Kingdom . |
| 2138343 | 10/1984 | United Kingdom . |
| 2227703 | 8/1990 | United Kingdom . |
| WO85/00317 | 1/1985 | WIPO . |

*Primary Examiner*—M. Rachuba
*Assistant Examiner*—Charles Goodman
*Attorney, Agent, or Firm*—Fitch, Even, Tabin & Flannery

[57] ABSTRACT

A belt skiving apparatus and method in which a free-standing blade-carrying carriage is employed which does not require a guiding base. The carriage has a pair of rollers defining a nip into which a belt end to be skived is passed. The rollers press together about the belt end to securely grip the belt. One of the rollers is toothed to provide a non-slip engagement with the surface of the belt and at least one of the rollers is driven, preferably manually, through a crank arm. Rotation of the rollers advances the carriage relative to the belt to advance the carriage across the width of the belt. As the carriage is advanced, the belt is passed through the rollers and through a cutting blade disposed adjacent the rollers. As the carriage is advanced along the width of the belt, the blade slices a thin strip of the upper portion of the belt adjacent its upper face from the remainder of the belt. The thin strip that is removed is the portion of the belt that was punctured by the teeth of the driving roller. The carriage is preferably wheel mounted to roll across the width of the belt directly on a support surface, without the need for a guiding base.

9 Claims, 3 Drawing Sheets

METHOD AND APPARATUS FOR SKIVING BELT ENDS

This application is a continuation, of application Ser. No. 08/301,696 filed Sep. 7, 1994 now abandoned.

FIELD OF THE INVENTION

The present invention pertains to devices for cutting a layer of material from a conveyor belt.

BACKGROUND OF THE INVENTION

Conveyor belt ends are commonly joined together by mechanical fasteners which are fastened to either end of the belt and fastened to one another to connect the belt ends and form a continuous loop. In many applications, it is desirable to skive the belt to form undercuts or grooves in the upper and/or lower surfaces of the belt to receive the mechanical fasteners. Considerable problems have been encountered with currently existing methods and apparatus for skiving belt ends.

U.S. Pat. No. 4,315,450 discloses a device which has performed satisfactorily for skiving belt ends and British patent application 2 227 703A published Aug. 8, 1990 discloses another device proposed for skiving belts. These devices employ a guiding base to which a belt end is clamped, and along which a blade-carrying carriage is guided for reciprocal sliding movement along the base. The base represents a significant portion of the overall cost of these devices and is a large member that often must be transported to the belt location. The base can be both heavy and awkward to carry. Also, with these devices, the belt is required to be securely clamped in stationary position to the base prior to reciprocation of the carriage. The clamping of the belt to the base prior to skiving the belt is time-consuming. There is a need for a skiving apparatus and method which does not require a separate carriage-guiding base or clamping of the belt to a base, and yet produces accurate skiving of belts.

It has been a particular problem to obtain the necessary force to pull a skiving blade through tough fabric, cords, rubber, or other plastic materials in a strong tough conveyor belt. Thus, in the aforementioned U.S. patent there is a base secured to the belt and a winch and cable mounted on the base to exert a pull on the skiving carriage. In the aforementioned British patent, the base is provided with a long rack and the carriage is provided with a pinion gear that meshes with the rack on the base so that turning of the gear causes the carriage to travel forwardly along the base pulling the blade through the belt.

Furthermore, in the prior art devices, the blade carrying carriages experience considerable drag in their sliding movement across the belt when being pulled by a long cable or the like thereby, making manual operation more difficult and time consuming. For instance, the cable of the winch drive of U.S. Patent No. 4,315,450 pulls the top of the carriage in a downward direction which tends to dig the blade in deeper and to provide a downward component of force on the slidable carriage causing increased resistance to carriage travel along the base. There is a need for a belt skiving device which reduces hang-up and drag of the blade-carrying carriage and provides the force to drive the carriage blade through the belt without a large base for carrying a rack or a winch.

The upper surface of the worn belts are often uneven because of uneven wear the belt has experienced. When a base is clamped to such an uneven surface, it is more difficult to obtain a precise depth of cut and to obtain a substantial uniform depth of cut when skiving such a belt. Thus, there is a need for a device which accurately skives a belt end to produce a predetermined belt thickness at the skived portions of the belt end, regardless of unevenness of the upper surface of a belt due to uneven wear of the upper surface or the like.

SUMMARY OF THE INVENTION

In accordance with the present invention, a belt skiving apparatus and method are provided in which a free-standing blade-carrying carriage is employed, which does not require a guiding base having a rack or a winch thereon to provide the force to cut the tough conveyor belt. This is achieved by driving the blade carrying carriage along the belt with a pair of rollers defining a nip to receive the belt and providing a driving roller mounted on the carriage that will not slip on the belt as the driving roller is turned to propel the carriage across the belt with the skiving blade cutting tough conveyor belt material. The preferred driving roller is formed with teeth that puncture the strip being skived. Rotation of the toothed driving roller advances the carriage relative to the belt to advance the belt through the rollers and through a cutting blade disposed adjacent the rollers, whereby an upper portion of the belt passes above a horizontal portion of the blade, and a lower portion of the belt passes below the horizontal portion of the blade. As the carriage is advanced along the width of the belt by the rollers, the blade slices a narrow strip of the upper portion of the belt adjacent its upper face from the remainder of the belt. The carriage may be mounted on wheels to roll directly on a support surface, without the need for a guiding base. Since no guiding base is required, the skiving apparatus of the present invention may be significantly smaller in size and weight and also less expensive to produce than prior art skiving apparatus requiring a base.

Also, since the belt is gripped directly in the nip of the rollers of the carriage, it is not necessary to clamp the belt end in a stationary position prior to skiving the belt end. This makes skiving carried out with the skiving apparatus of the present invention significantly more simple and less time-consuming than prior art skiving apparatus.

Still further, since the lower face of the belt bears firmly against one of the rollers during skiving, the thickness of the belt may be registered or measured from the bottom of the belt, rather than being measured from the upper surface. Hence, the skiving apparatus produces a groove of substantially uniform thickness, regardless of the presence of unevenness in the upper face of the belt prior to skiving.

In addition to overcoming the aforementioned shortcomings associated with prior art skiving apparatus, the skiving apparatus of the present invention lends itself to simple and economical manufacture, and has been found to be easy to use manually in limited space applications such as in narrow coal mine shafts and produce good, substantially uniform grooves.

BRIEF DESCRIPTION OF THE DRAWINGS

In the drawings, wherein like elements are referenced alike.

DETAILED DESCRIPTION OF THE PREFERRED EMBODIMENTS

Figure 6:
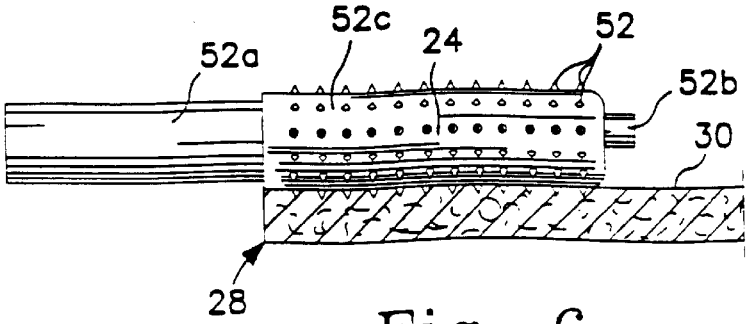
FIG. 6 is an enlarged, partial front elevational view showing the engagement of the driving roller with the belt.

As shown in the drawings for purposes of illustration, the invention is embodied in a skiving apparatus 20 that has a carriage 22 carrying a skiving blade 34 for cutting a strip 40 from the belt 28. The carriage may have wheels 110 for rolling across a supporting surface, such as a workbench or conveyor support plate (not shown) and the belt is passed through a nip formed between a pair of rollers 24 and 26. In accordance with the present invention, the force for driving the cutting blade 34 through the belt is from the pair of rollers 24 and 26 at least one of which is provided with a non-slip surface, such as tooth surface, and is driven. As best seen in FIG. 6 the preferred driving roller 24 has teeth 52 that puncture an upper surface area of the belt, which area is being skived. The driving roller is located on the carriage closely adjacent the cutting blade and a pinch roller 26 for the driving roller, thereby eliminating the long winch cables or racks on long bases of the prior art skiving devices.

More specifically the driving roller 24 and pressure roller 26 are pressed together against respective upper and lower faces 30 and 32 of the end portion 33 of the belt 28 to clamp the belt therebetween. The skiving blade 34 has a generally horizontal blade portion 36 adjustable to any selective position between the rollers 24 and 26. The driving roller 24 is manually rotatable through a crank arm 38. Rotation of the driving roller 24 advances the carriage 22 relative to the belt 28 to advance the belt 28 through the rollers 24 and 26 and through the cutting blade 34, with an upper strip or portion 40 of the belt 28 passing above the horizontal portion 36 of the blade 34 and a lower portion 42 of the belt 28 passing below the horizontal portion 36 of the blade 34. The blade 34 slices the upper portion 40 of the belt 28, adjacent its upper face 30, from the remainder of the belt 28. As the driving roller 24 is rotated, the carriage 22 is advanced across the width of the belt 28 to advance the blade 34 relative to the belt 28 to skive the belt across its width. The rollers 24 and 26 engage the belt directly so that no separate base is required as in the prior apparatus. Since the belt is clamped securely by the toothed roller 24 and pinch roller 26 which are disposed adjacent the blade 34, there is little slippage or play of the belt 28 with respect to the blade as the belt is being skived, which allows skiving of thinner upper belt portions than previously attainable while also producing a good, uniform groove in the belt.

Also, the carriage 22 is free-standing, rather than moving within a channel of a base as in the prior art; so that the potential problem of hang-up or sticking of the carriage within the channel is eliminated with the structure of the present invention. Still further, the lower face 32 of the belt 28 bears against the pressure roller 26 during cutting of the belt 28, and the blade 34 is adjustably positionable to a selective distance from the pressure roller 26 to cut the belt to a selective thickness as measured from the lower face 32 of the belt, to overcome variations in thickness associated with wear of the upper face of the belt. Hence, the skiving apparatus of the present invention can cut off an uneven upper face 30 of a belt 28 and produce a groove with the belt having uniform thickness at the groove despite the unevenness of the upper face 30 of the belt 28 at the groove prior to skiving.

Figure 1:
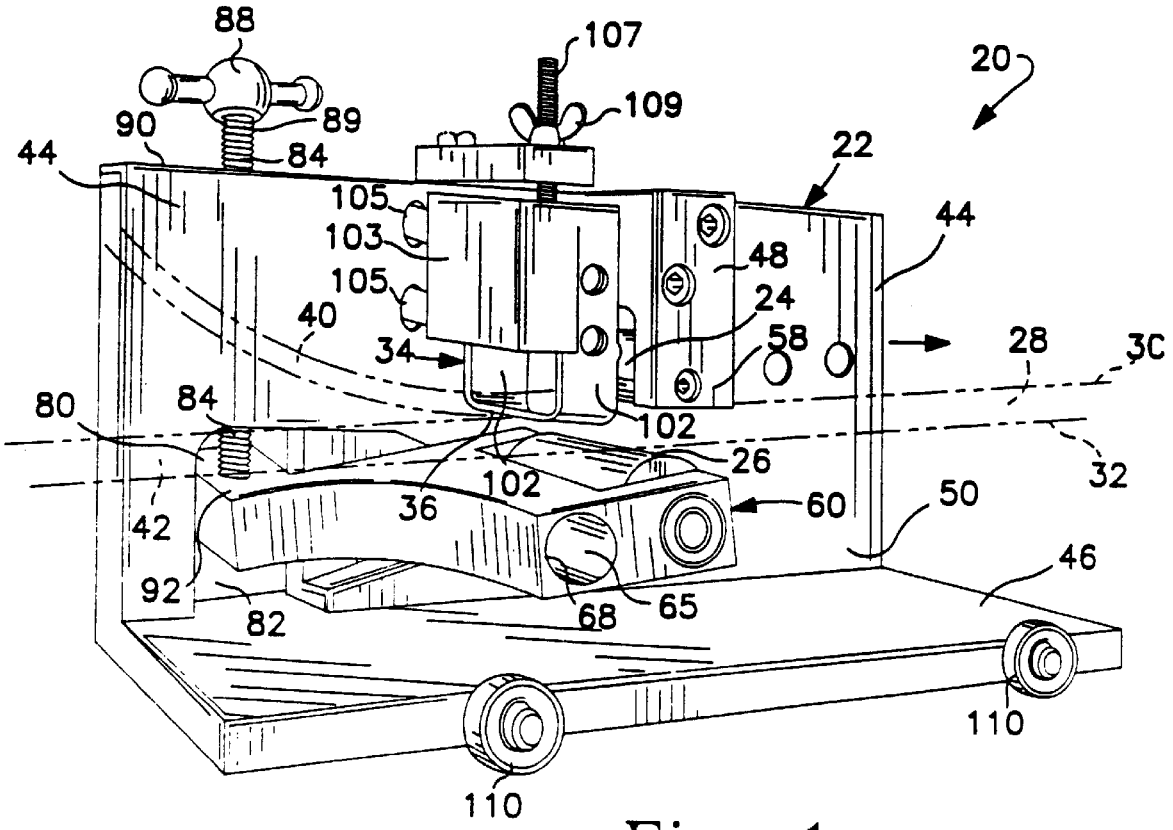
FIG. 1 is a perspective view of a belt skiving apparatus embodying various features of the present invention.
Figure 7:
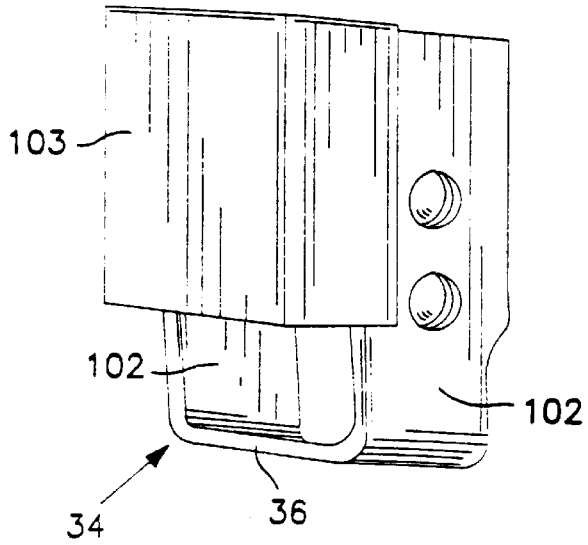
FIG. 7 is an enlarged, perspective view of the cutting blade of the apparatus of FIG. 1.
Figure 3:
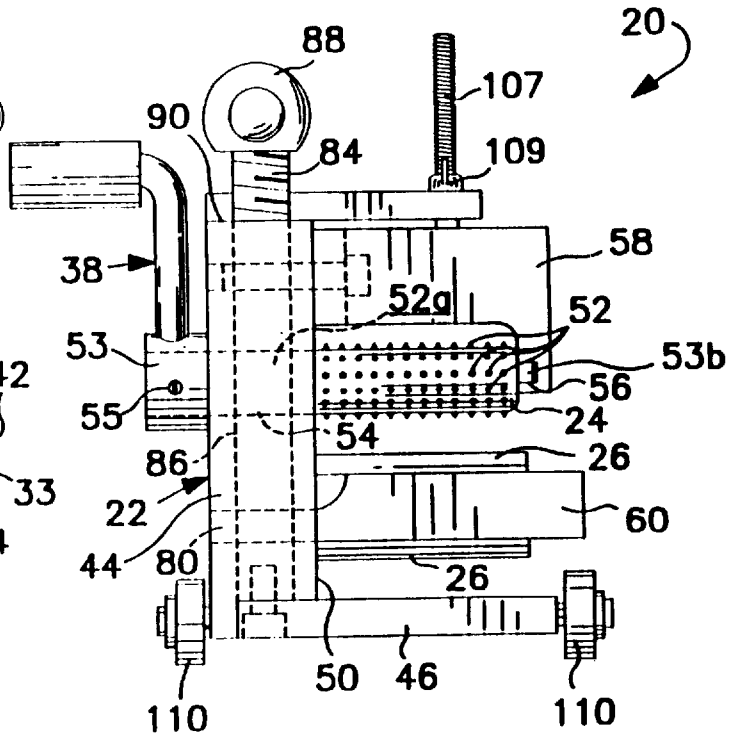
FIG. 3 is a side elevational view of the belt skiving apparatus of FIG. 1.

The illustrated carriage 22 is a generally L-shaped plate which defines integral vertical wall 44 and horizontal wall 46. The carriage 22 may be formed of metal plates, but for reduced manufacturing cost may alternatively be produced of plastic. The driving roller 24 is mounted at a fixed position on the front side 50 of the vertical wall 44. An L-shaped bracket 48 extends from the front side 50 of the vertical wall 44 to rotatably support the driving roller 24 about a fixed rotational axis. As best seen in FIGS. 1 and 3, the driving roller 24 is preferably formed in one piece with stub axles 52*a* and 52*b* (FIG. 6) on opposite ends of a larger diameter center portion 52*c* that has the integral teeth 52 thereon. The stub axles 52*a* and 52*b* are each received in a respective bearings 54 of the vertical wall 44 and a bearing 56 of the L-shaped bracket leg 58 which mounts the roller for rotation about its fixed rotational axis. The axle 52*a* received in the bearing 54 of the vertical wall 44 is an elongated axle which extends completely through the vertical wall and is received in the base 53 of the crank arm 38 and secured by screw 55 for driving rotation of the driving roller 24 as described further below.

To accommodate belts of various thicknesses, the pressure roller 26 is disposed on a pivotal bracket 60 to allow selective adjustment of the height of the pressure roller 26 relative to the driving roller 24. By pivoting the bracket 60, the space between the pressure roller 26 and the driving roller 24 may be varied as desired for a given belt thickness, as explained further below. Manifestly, with a mere reversal of parts, the driving roller 24 may be mounted on a pivotal bracket, such as the bracket 60, so that the pivoting of the bracket carrying the driving roller shifts the driving roller into a clamped position to clamp the belt between the driving roller and pressure roller. Thus, at least one of the driving or pressure rollers is movable into an engaging position. Also, by a mere reversal of parts, the driving roller may be mounted to engage the bottom of the belt; and the pressure roller may be mounted to engage the bottom of the belt.

Figure 8:
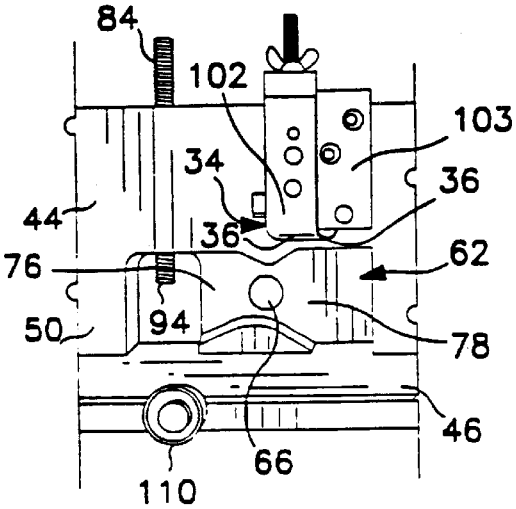
FIG. 8 is partial elevational view of the front side of the vertical wall of the carriage, showing the hourglass-shaped recess in the wall and the aperture through the wall.

As best seen in FIGS. 1 and 8, the front side 50 of the vertical wall 44 of the carriage 22 has a generally hourglass-shaped recess 62 formed therein. The pressure roller supporting bracket 60 pivots about a pivot pin 65 which extends into a bore 68 in the bracket 60 and a bore 66 in the vertical wall 44. The portion of the bracket 60 disposed on one side of the pivot pin 65 is an adjusting arm portion 72, and the portion of the bracket 60 disposed on the other side of the pivot pin 65 is a pressure roller supporting portion 74 having a U-shape with the pressure roller 26 supported on either end by legs 71 of the U-shaped portion 74.

Figure 5:
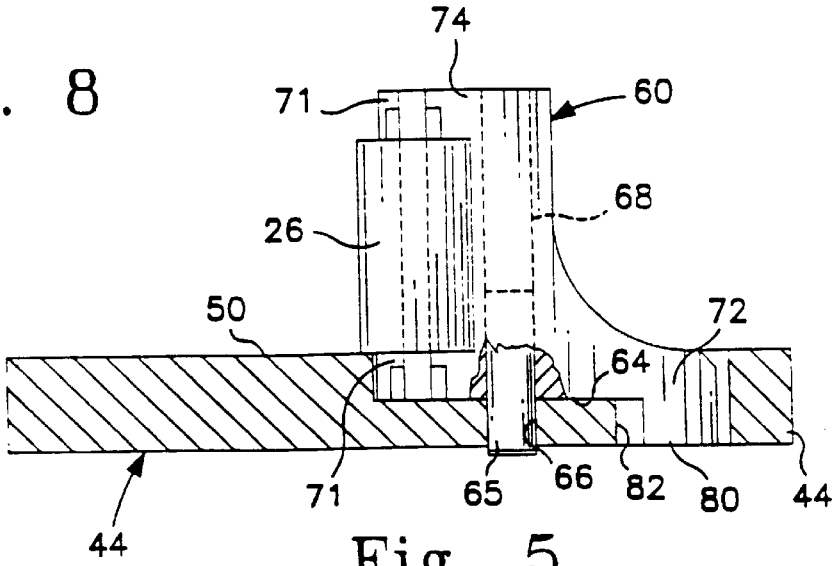
FIG. 5 is an enlarged, partial top view of the pressure roller showing its pivotal connection to the carriage.

The inner side 64 of the respective portions 72 and 74 of the pivotal bracket 60 are disposed in respective portions 76 and 78 of the recess 62 for oscillatory pivotal movement of the inner sides of the bracket portions 72 and 74 within respective recess portions 76 and 78. In the illustrated embodiment, the pressure roller 26 is disposed generally beneath the driving roller 24, and pivotal movement of the bracket 60 varies the distance between the driving roller 24 and the pressure roller 26 to accommodate belts of different thickness. To adjust the position of the pressure roller 26 with respect to the driving roller 24, the adjusting arm portion 72 of the bracket 60 has a short leg 80 which extends generally perpendicularly with respect to the inner side 64 of the bracket 60, and extends into an aperture 82 in the vertical wall 44 (see FIGS. 1 and 5). A threaded pivotal bracket adjusting member 84 is threadably received within a threaded bore 86, which extends generally vertically and parallel to the front side 50 of the vertical wall 44. The upper end 89 of the threaded pressure roller adjusting member 84 extends upwardly from the upper end 90 of the vertical wall 44, and the lower end 94 of the threaded member 84 extends down into the aperture 82 in the vertical wall 44 and bears against the upper side 92 of the leg 80 of the adjusting arm 72.

Figure 2:
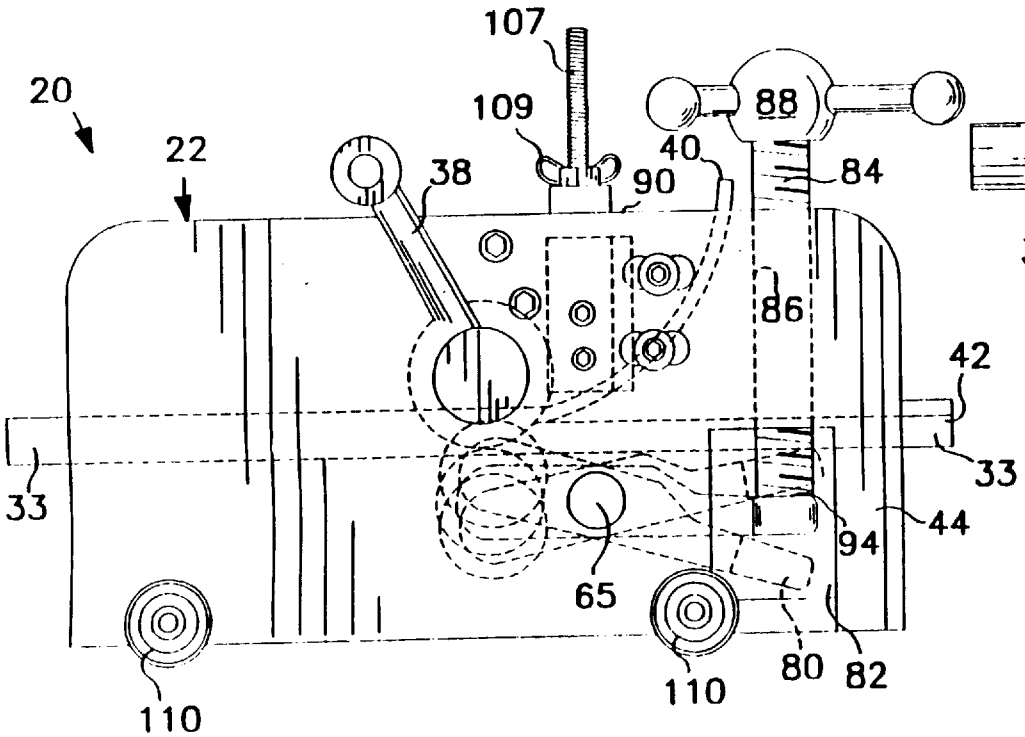
FIG. 2 is a rear elevational view of the belt skiving apparatus of FIG. 1.
Figure 4:
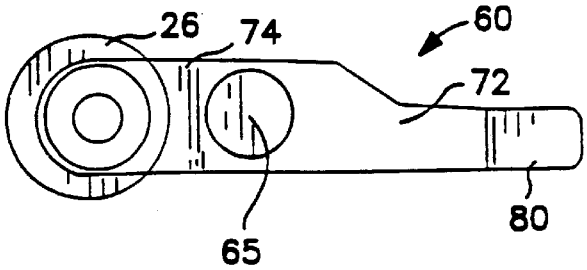
FIG. 4 is a side elevational view of the pressure roller of the apparatus of FIG. 1.

Accordingly, adjustment of the nip between the pressure roller 26 and the driving roller 24 and the pressure needed for the teeth 52 to puncture the belt is obtained for a given belt thickness by simple manual rotation of the handle 88 provided at the upper end 89 of the threaded adjusting member 84. Rotation of the handle 88 rotates the threaded adjusting member 84, which moves the lower end of the threaded member 84 vertically. Hence, clockwise rotation of the handle 88 moves the lower end 94 of the threaded member 84 downwardly to force the adjusting arm portion 72 of the bracket 60 downwardly, which in turn pivots the bracket 60 about pivot pin 65 to raise the pressure roller 26 upwardly and narrow the space between the pressure roller 26 and the driving roller 24. Similarly, counter-clockwise rotation of the handle 88 moves the lower end 94 of the threaded member 84 upwardly to allow the adjusting arm portion 72 of the bracket 60 to move upwardly, which in turn pivots the bracket 60 about pivot pin 65 to lower the pressure roller 26 downwardly, and enlarge the space between the pressure roller 26 and the driving roller 24. FIG. 2 illustrates the variable positioning of the pressure roller.

In practice, the handle 88 may be rotated counter-clockwise so that the space between the rollers 24 and 26 is greater than the thickness of the belt 28 to be skived. A leading end of the belt 28 is inserted between the rollers 24 and 26 and held in place as the handle 88 is rotated clockwise to raise the pressure roller 26 upwardly into abutment with the lower face 32 of the belt 28. The handle 88 is then rotated clockwise further, to securely clamp the belt 28 between the rollers 24 and 26 and to cause the teeth 52 to puncture the belt strip to be severed. With the belt 28 firmly engaged between the rollers 24 and 26, rotation of the driving roller 24 advances the belt 28 through the rollers 24 and 26, as described further below.

The cutting blade 34 is preferably disposed directly adjacent the rollers 24 and 26 to slice off a layer of the belt 28 adjacent its upper face 30, as the rollers 24 and 26 grip and advance the blade 34 across the width of the belt 28. Unlike the aforementioned prior art skiving apparatus in which the belt is either clamped to a base at its edges prior to skiving or nailed to a base across its entire width prior to skiving, the belt skiving apparatus of the present invention does not require such time-consuming clamping preparations prior to carrying out skiving of the belt, as the same rollers 24 and 26 which drive the carriage 22 across the belt 28 also clamp the belt securely during cutting. That is, the rollers 24 and 26 clamp the belt securely directly adjacent the blade 34 during skiving. The rollers 24 and 26 maintain clamping engagement of the belt 28 directly adjacent the blade 34 throughout advancement of the carriage 22 across the width of the belt 28 so that the belt is gripped securely by the rollers 24 and 26 directly adjacent the blade 34 throughout skiving of the belt by the blade 34. This has been found to provide significantly improved accuracy in the grooves formed by skiving, which allows thinner upper layers to be accurately removed than previously obtainable.

The illustrated blade 34 is U-shaped having a central, generally horizontal blade portion 36 and two spaced vertical blade portions 102 extending upwardly at and from opposite ends of the central horizontal blade portion 36. Other shapes of blades, such as a horizontal blade, may be used instead of the U-shaped blade. The forward edges of the horizontal and vertical blade portions 36 and 102 are sharp cutting edges. The vertical blade portions 102 fit in recesses in opposite faces of a blade holding block 103 and are secured to the blade holding block 103 by spaced bolts being threaded into the block through openings in the blade. The block 103 is supported in turn by bolts threaded into taps in the block and protruding through slots 105 in the vertical wall 44 of the carriage 22. Upon tightening the bolts against the slides, the block can be held with the horizontal blade portion 36 at any adjusted depth below the upper face 30 of the belt so as to cut away the upper portion 40 of the belt 28 and form the desired groove adjacent the belt end. To assist in holding the block while the bolts are being tightened, a holding screw 107 may be employed with its lower end threaded into the top of the holding block 103. The block may be held in place with one hand by wing nut 109 while the operator tightens the bolts to secure the blade with the other hand.

As discussed above, the driving roller 24 is operatively coupled to the base 53 of the crank arm 38 through axle 52*a*. Hence, the driving roller 24 may rotated by the operator manually gripping the handle of the crank arm 38 and rotating the crank arm 38. Manifestly, rather than a direct connection between the driving roller 24 and the crank arm 38, the crank arm 38 may be operatively connected to the driving roller 24 through gears to obtain a mechanical advantage. However, it has been found that the force required to advance the belt 28 through the blade 34 to skive the belt, with the structure of the belt skiving apparatus of the present invention, is sufficiently small that no gears are required. The crank arm constitutes a power operator that provides a mechanical advantage to drive and turn the driving roller; and, alternatively the power operator may be a motor that is connected to the drive wheel to drive and turn the drive wheel. Although a motor may be employed to drive the drive roller, however, due to the extra space which external drives require and the added production cost, external drives are not desired. Hence, to minimize production costs, no gears or external, automated roller driving equipment are employed in the preferred embodiment of the invention.

The driving roller 24 preferably has a non-slip surface, preferably such as short spikes or teeth 52 extending about its periphery. As best illustrated in FIG. 6, the spikes 52 dig into the upper face 30 of the belt 28 when the belt 28 is clamped between the rollers 24 and 26 to securely grip the belt and prevent slippage of the belt with respect to the driving roller 24. Hence, upon rotation of the crank arm 38, the drive roller 24 rotates and its teeth 52 dig into and grip the upper face 30 of the belt as the drive roller rotates, to securely grip the belt and advance the belt with respect to the blade 34. Other alternatives to teeth may be roughened surfaces or the like to prevent slippage of the drive roller 24 on the belt surface as the drive roller is turned.

It is important, in order to produce a uniform groove in the belt with the skiving apparatus 20 of the present invention, that the end 33 of the belt being skived be maintained flush against the front side 50 of the vertical wall 44 throughout advancement of the carriage 22 along the width of the belt, and not migrate away from the front side 50 of the vertical wall 44 as the carriage is driven across the width of the belt.

This may be carried out in any of several ways. For instance, additional rollers may be provided to guide and hold the belt directly adjacent the front side 50. Alternatively, the rollers 24 and 26 may be tapered in the direction of the vertical wall 44 to urge the belt 28 in the direction of the vertical wall 44.

Also, to allow for variability of the width of the groove cut into the belt, means may be provided for adjusting the position of the front side 50 of the vertical wall 44 and/or the spacing of the blade 34 from the vertical wall. For instance, an adjustable thin plate may be provided adjacent and generally parallel to the vertical wall 44. The plate may be moved toward and away from the vertical wall 44 so that with the belt end 33 abutted against the plate, the plate allows for selective variability of the width of the groove from the end 33 of the belt 28. The position of the blade 34 may also be adjustable for variation of the width of the groove formed in the belt, with the blade being movable closer to the front side 50 of the vertical wall 44 for formation of thinner grooves and movable further from the front side 50 of the vertical wall 44 for formation of wide grooves.

In carrying out skiving of a conveyor belt in accordance with the present invention, an end portion of a belt is passed between a pair of rollers which clamp about the belt. One of the rollers is a driving roller which is rotated to advance the blade-carrying carriage with respect to the belt across its width. The illustrated carriage has rollers which roll across the width of the belt as the belt is advanced through the rollers. The illustrated carriage has wheels, but the carriage may be constructed without any wheels. A cutting blade is disposed adjacent the rollers, and positioned such that the rollers force an upper portion of the belt above the blade and a lower portion of the belt below the blade. The forward edge of the blade thus slices off the upper part of the belt from the remainder of the belt as the carriage is advanced along the width of the belt.

What is claimed is:

1. A skiver apparatus for cutting grooves in conveyor belts, the skiver apparatus comprising:

a traveling carriage including a body having a rearward end and a forward end, and a side wall extending between the ends of the body;

a belt cutting blade extending away from the side wall of the carriage body for cutting a groove in a conveyor belt as the carriage body is advanced in a forward direction along the belt;

a pair of rollers that are spaced from each other and which extend away a predetermined distance from the side wall of the carriage body to distal ends thereof spaced from the side wall, at least one of the rollers being movable towards the other roller for adjusting the space therebetween for clamping onto the belt and traveling thereacross as the rollers are rotated; and a belt receiving opening at the predetermined distance from the carriage body side wall between the distal ends of the rollers with the belt receiving opening generally lying in a plane that extends between the rollers and toward and away from the side wall of the carriage body and toward the forward and rearward ends of the carriage body to allow the belt to be fed along the plane toward the side wall, wherein the belt extends away from the body side wall and out from the belt receiving opening, and the rollers are clamped and advanced along said plane as the carriage travels in the forward direction.

2. The skiver apparatus of claim 1 wherein one of said pair of rollers is a driving roller, and the skiver apparatus further comprises a power operator mounted to the carriage for rotating the driving roller.

3. The sliver apparatus of claim 2 wherein the power operator is a crank arm connected to the driving roller for manual rotation thereof.

4. The skiver apparatus of claim 1 wherein one of said pair of rollers includes a non-slip surface for securely gripping the conveyor belt when clamped thereon.

5. The skiver apparatus of claim 1 wherein the belt cutting blade is mounted to the carriage body in a fixed and stationary position thereon during a cutting operation and generally is U-shaped having a horizontal central portion and two spaced vertical portions extending upwardly at and from opposite ends of the central horizontal blade portion.

6. The skiver apparatus of claim 1 wherein the blade is mounted to the carriage to be selectively shiftable between different fixed positions relative to the rollers for varying the groove cut in the conveyor belt.

7. The skiver apparatus of claim 1 wherein the cutting blade extends away from the carriage body for a distance that is equal to or less than the predetermined distance that the rollers extend away from the carriage body.

8. The skiver apparatus of claim 1 wherein the side wall is integral with the carriage body.

9. The skiver apparatus of claim 1 wherein the carriage body includes wheels for rolling transport of the carriage on a support surface.

* * * * *